US005639201A

United States Patent [19]

Curotto

[11] Patent Number: 5,639,201

[45] Date of Patent: Jun. 17, 1997

[54] MATERIALS COLLECTING APPARATUS

[76] Inventor: John D. Curotto, 20418 5th St. E., Sonoma, Calif. 95476

[21] Appl. No.: 575,496

[22] Filed: Dec. 20, 1995

Related U.S. Application Data

[63] Continuation of Ser. No. 202,923, Feb. 25, 1994, abandoned.

[51] Int. Cl.[6] ..... B65F 3/04

[52] U.S. Cl. ..... 414/408; 294/86.4; 414/406

[58] Field of Search ..... 414/406, 401, 414/408, 303, 419, 420, 421; 294/86.4, 111

[56] References Cited

U.S. PATENT DOCUMENTS

| | | | |
|---|---|---|---|
| 3,516,562 | 6/1970 | Knight . | |
| 3,762,586 | 10/1973 | Updike, Jr. . | |
| 3,822,802 | 7/1974 | Evans | 414/501 |
| 3,841,508 | 10/1974 | Ebeling et al. . | |
| 4,401,407 | 8/1983 | Breckenridge | 414/408 |
| 4,435,117 | 3/1984 | House | 294/86.4 |
| 4,461,607 | 7/1984 | Smith . | |
| 4,461,608 | 7/1984 | Boda | 414/408 |
| 4,543,028 | 9/1985 | Bell et al. . | |
| 4,613,271 | 9/1986 | Naab . | |
| 4,669,940 | 6/1987 | Englehardt et al. . | |
| 4,708,570 | 11/1987 | Smith et al. | 414/408 |
| 4,966,514 | 10/1990 | Knapp . | |
| 4,992,018 | 2/1991 | Prout et al. . | |
| 5,007,786 | 4/1991 | Bingman . | |
| 5,015,142 | 5/1991 | Carson . | |
| 5,015,143 | 5/1991 | Carson . | |
| 5,018,929 | 5/1991 | Carson . | |
| 5,020,844 | 6/1991 | Pickrell . | |
| 5,026,104 | 6/1991 | Pickrell . | |
| 5,028,196 | 7/1991 | Richards . | |
| 5,045,026 | 9/1991 | Buse . | |
| 5,049,026 | 9/1991 | Bingman . | |
| 5,056,979 | 10/1991 | Niederer et al. . | |
| 5,088,531 | 2/1992 | Wade . | |
| 5,092,731 | 3/1992 | Jones . | |
| 5,209,537 | 5/1993 | Smith et al. | 294/111 |
| 5,266,000 | 11/1993 | LeBlanc, Jr. . | |
| 5,308,211 | 5/1994 | Bayne . | |
| 5,333,984 | 8/1994 | Baynet et al. . | |
| 5,484,245 | 1/1996 | Zopf | 414/408 |

FOREIGN PATENT DOCUMENTS

| | | | |
|---|---|---|---|
| 751794 | 7/1980 | U.S.S.R. | 294/86.4 |
| 1248902 | 8/1986 | U.S.S.R. | 414/408 |
| 2224004 | 4/1980 | United Kingdom | 414/408 |
| 2092987 | 8/1982 | United Kingdom | 414/408 |
| 93/25457 | 12/1993 | WIPO | 414/408 |

*Primary Examiner*—Thomas J. Brahan
*Attorney, Agent, or Firm*—Coudert Brothers

[57] ABSTRACT

A materials disposal system comprising a relatively large, open-top container adapted to be removably coupled to the forks or blades of a front-end loading vehicle. Thus, the vehicle can be used either with or without the container releasably attached thereto. A work bucket is to be picked up at a number of spaced locations along a street. Each work bucket is to be shifted relative to a holder arm having a flexible strap which is to be shiftably mounted on the container. The strap is moved from a position adjacent to and free of the work bucket to a position partially embracing and engaging the work bucket. The holder arm coupled to the strap is then swung up into a dumping position from which it dumps materials from the work bucket into the open top of the container. The arm returns to its initial position to return the work bucket to the ground. Then, the vehicle advances to the next work bucket where it picks up the next work bucket. This continues until all of the work buckets have been emptied.

34 Claims, 9 Drawing Sheets

MATERIALS COLLECTING APPARATUS

This application is a continuation of application Ser. No. 08/202,923 filed Feb. 25, 1994, now abandoned.

This invention relates to automated work buckets of the type suitable for collecting materials and garbage and, more particularly, to a trash vehicle and method of operation of the vehicle.

BACKGROUND OF THE INVENTION

Typically, materials collection companies require two types of vehicles to collect materials. These two types include a front loader for commercial accounts and rear or side loaders for residential customers. It is common practice to keep spare trucks available to replace regular route trucks when the latter break down. When it becomes necessary to convert the residential routes to automatic pick up, it is necessary for a company to purchase an automated truck at the cost of about $140,000. Also, one must provide each customer with a special cart and look for a used, automated truck or otherwise convert one of their existing trucks to be used in the case of break-down of regular route trucks.

In view of the foregoing problem, a company or individual could spend a considerable amount of money in purchasing backup trucks for cases where the trucks break down. Thus, an enormous investment is required to accomplish this purpose, and it behooves a company in the materials collection business to consider a cheaper alternative rather than invest such a large amount of money in backup vehicles. Thus, a need exists for improvements in materials collecting trucks and pick up techniques which will allow residential and other sidewalk pick ups while keeping the investment in capital equipment at a minimum. The present invention satisfies this need.

SUMMARY OF THE INVENTION

The present invention is directed to a materials pick up apparatus and method of operation wherein the trash vehicle of the present invention will allow a company owner or user to use existing front-loading equipment with little modification to collect materials in existing containers. The capital expense to accomplish the change will be minimal.

The materials collector of the present invention is well adapted for use in the collection of yard waste. The collection of yard waste is an ever-increasing program as a result of, for instance, the State of California mandates to reduce the volume of refuse going to landfills. When collecting yard wastes for composting, it is important to ensure that they are free of other contaminants. In some areas with automated service, yard wastes must be manually picked up since the driver cannot see the contents of the container which is being dumped. The design of the materials pick up apparatus of the present invention allows the driver to see the contents of the container as they are being dumped into the container. In the event that the contaminants are sighted, they can be put back into the container and a note can be left for the owner.

In addition, the design of the apparatus of the present invention is such that it can be used to pick up not only those carts designed for other automatic pickers, but it would also be able to pick up standard and almost standard trash cans. This would allow a company to convert to automatic pick up of yard waste without going to the expense of purchasing a special cart for each customer. The carts cost about $75 per unit. Customers could simply be asked to use their own container or to purchase one at a local hardware store.

The present invention is directed to a materials disposal system comprising a relatively large, open-top container which is adapted to be removably coupled to the forks or blades of a front-end loading vehicle. Thus, the vehicle can be used either with or without the container releasably attached thereto.

The materials disposal system of the present invention also includes an improved work bucket or drum for picking up materials at spaced locations along a street, there being a work bucket at certain or all of said locations. Each work bucket is to be shifted relative to a holder arm having a flexible strap which is shiftably mounted on the container. The work bucket is first coupled to a strap member where the strap member is moved from a position adjacent to and free of the work bucket to a position partially embracing the work bucket, supported on the ground. A holder arm coupled to the strap member is then swung up into a dumping position from which it dumps materials from the work bucket into the open top of the container. The arm returns to its initial position as it returns the work bucket or drum to support on the ground. Then, the vehicle advances to the next work bucket where it picks it up and dumps the contents of the work bucket into the open top of the container. This continues until all of the work buckets have been emptied.

In the present invention, the driver of the vehicle is able to see the content of the drums and work buckets as they are being dumped into the container. The system of the present invention allows a company to convert to automatic pick up of yard wastes without going to the expense of purchasing a special cart for each customer.

The unit can also be used for materials collection on fully or semi-automated routes. With the addition of a partition in the work bucket, two separate compartments are created which will allow for collection of yard wastes and regular materials by the same unit. This will eliminate the need to send two different trucks on the same route to accomplish each of the operations of the now standard practice.

The system of the present invention provides a low-cost, automated backup unit for use when a primary unit breaks down. The unit can dump both automated carts and regular cans that most customers already have. On those trucks that have front-mounted double pumps, the automated work bucket can work at idle without putting the truck in neutral. After a minor modification to the truck, the system of the present invention can be quickly connected to and disconnected from the truck in seconds. The cycle time to pick up, dump and replace the container is about eight seconds. The unit minimizes down time because of the simple design and the minimum number of intricate parts. The unit can be made for either left or right side pick up. The low loading height makes it possible for the driver to manually load extra garbage set by the side of the can. The dumping height is low which allows for efficient operation in areas where there are trees along the city streets. The unit affords efficient operation in a cul-de-sac where there are sharp turns that tend to hinder operation of automated pick up systems.

The primary object of the present invention is to provide an improved collection system wherein an open top container is carried by the forks or blades of a front end loader vehicle, and a holder with a flexible strap adapted to embrace a work bucket is coupled releasably to the work bucket, whereupon the arm can be raised and the work bucket inverted to dump the contents of the work bucket into the container, following which the work bucket is replaced into the initial position thereof, and the vehicle advanced to the next pick up station.

Other objects of the present invention will become apparent as the following specification progresses, reference being had to the accompanying drawings for an illustration of the invention.

DETAILED DESCRIPTION OF THE PREFERRED EMBODIMENT

Figure 1:
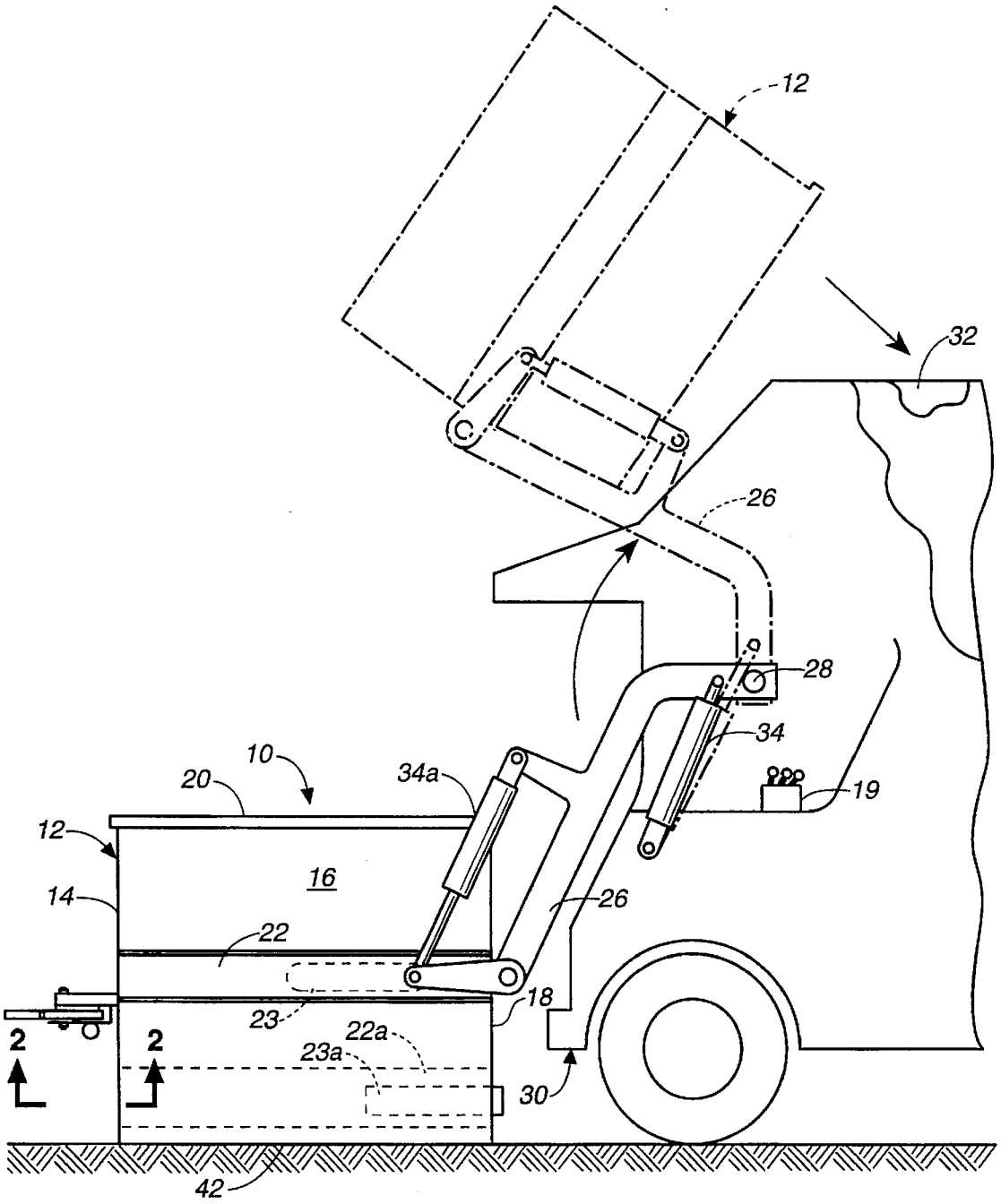
FIG. 1 is a side elevational view of a first embodiment of the materials container of the present invention, showing the way in which the container is lifted from ground level into a dumping position with respect to the front end opening of a front loader vehicle.

The first embodiment of the materials collection system of the present invention is broadly denoted by the numeral 10 and includes a container 12 having a front face 14 and a pair of side faces 16, and a rear face 18. The container has an open top 20 and it could have divider panels for segregating the materials which it collects in a manner hereinafter described. While the collection system is suitable for collecting materials of different types, it is especially suitable for collecting trash.

The container 12 has a blade receiving compartment 22 at each side 16, respectively intermediate the top and bottom of the container. The compartments 22 are adapted to receive conventional blades or forks 23 which are removably carried by conventional links 26 mounted by pivot pins 28 on a front loader vehicle 30 having a top front opening 32. A power device **34*a* is operable to manipulate the blades 23 and a power device 34 is operable to lift linkages 26 into the dashed line position of FIG. 1 where the power device 34*a* will be actuated to rotate blades 24, and thereby container 12 into a position in which it dumps the contents of the container in the bed 40 of vehicle 30 through the open top front opening thereof. Reverse movement of the various parts described immediately above is sufficient to return the container 12** to its normal position at which it is elevated slightly from the ground.

Figure 10:
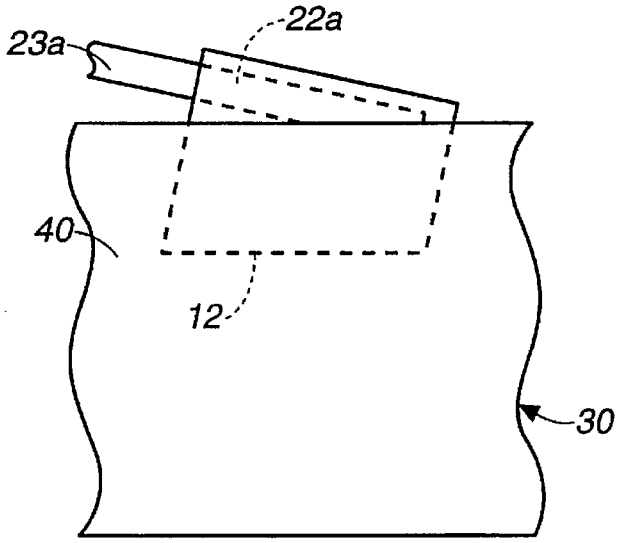
FIG. 10 is a view somewhat like FIG. 1 except that FIG. 10 shows the container substantially within the bed 40 of the vehicle 30 so that the container can be carried in the bed as the vehicle moves to a dumpsite remote from the materials pick up site.

As an optional embodiment, the container can have compartments **22*a* near the bottom of the container as shown in FIG. 1 and the links 26 will be lengthened to permit blades 23*a* to be inserted into the compartments 22*a* so that the container will be carried by the blades at the lower portion of the container. This permits the container to be lifted by power device 34 into a position such as the position shown in FIG. 10, wherein the container is substantially within the bed 40 of the vehicle so that the container can be safely placed in the bed and taken to a dumpsite where the contents of the bed are dumped, all of which can be accomplished without having to separate the container 12 from the vehicle and the vehicle can be driven to the dumpsite with the container in the bed as shown in FIG. 10. This is achievable because the blades 23*a* are within the compartments 22*a* near the bottom of the container, thus providing greater control of the container as it is shifted from the ground position shown in FIG. 1 to the elevated position shown in FIG. 10. If the blades are inserted in the compartments 22, as shown in full lines in FIG. 1, the container may not be sufficiently controlled so as to assume the position shown in FIG. 10**.

System 10 of the present invention has an L-shaped support arm 44 which has one segment 46 and a second segment 48 perpendicular to segment 46. Segment 46 is pivotally mounted by a pin 49 on a frame-like carriage 50 which is shiftably mounted on the front face 14 of container 12. A pair of tracks 52 and 54 are spaced apart from each other and are secured to the front face 14 of the container. Carriage 50 has rails 56 which are shiftably captured in recesses (not shown) on tracks 52 on container 12. Bearing means (not shown) are provided to mount the carriage 50 for movement laterally into the bucket pick up position of FIG. 4 and return.

A reversible hydraulic motor 60, having a sprocket 62 on a drive shaft 64, is coupled by the sprocket 62 to a chain 66 wound about the sprocket 62 and connected to a fixed point 68 on track 52 and a fixed point 69 on carriage 50. Actuation of motor 60 by directing hydraulic fluid to the motor causes the motor shaft to rotate in one direction or the other. Thus, by control of motor 60, the lateral position of frame 50 and thereby support arm 46 can be selectively placed at the side of the container.

Figure 4:
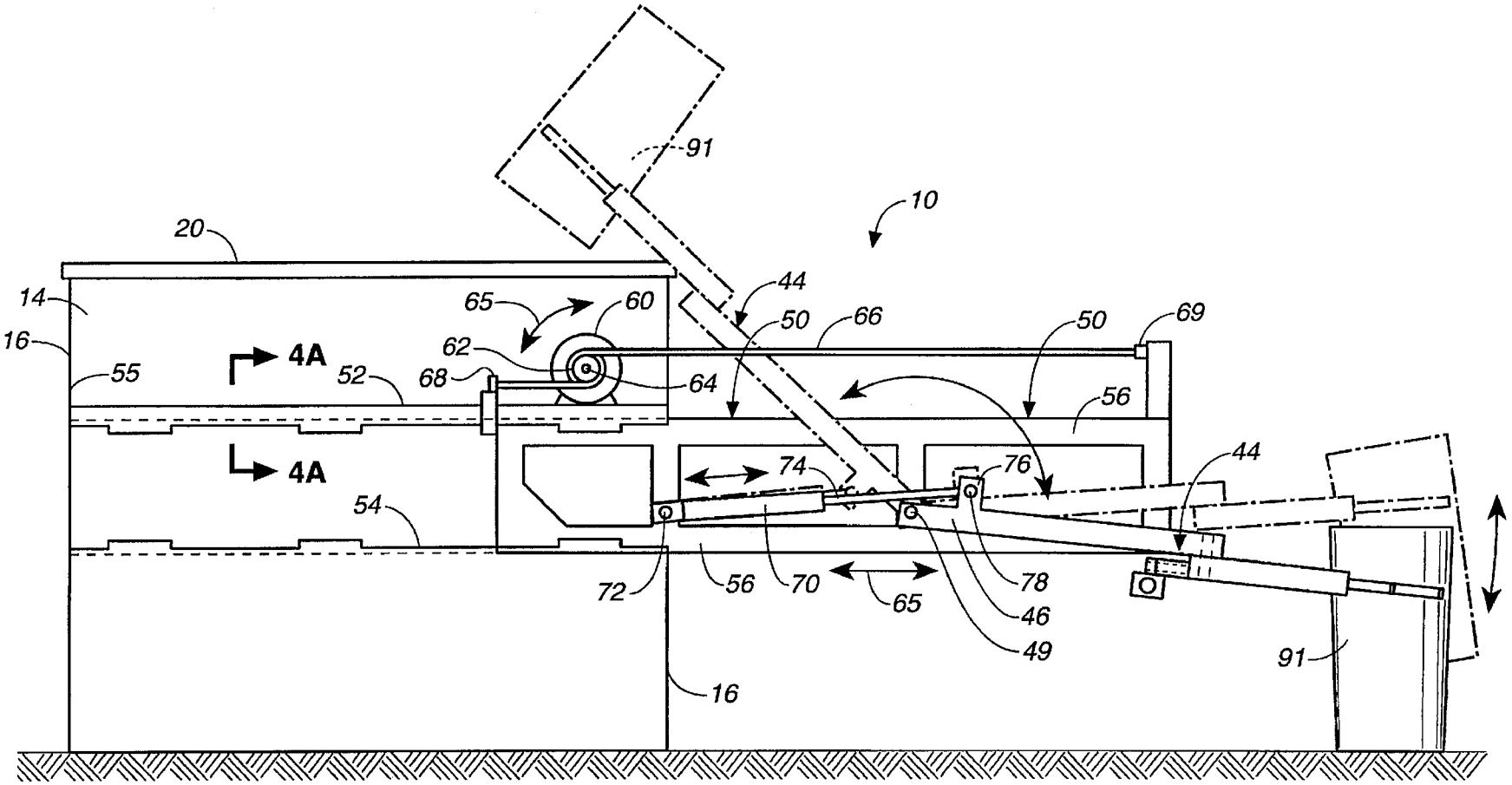
FIG. 4 is a front elevational view of the system of the present invention, showing the carriage for the holding means, the carriage being on the front face of the container and the sequence of positions of the holder arm and the work bucket being shown in dashed lines to illustrate details of the function of the system of the present invention.
Figure 5:
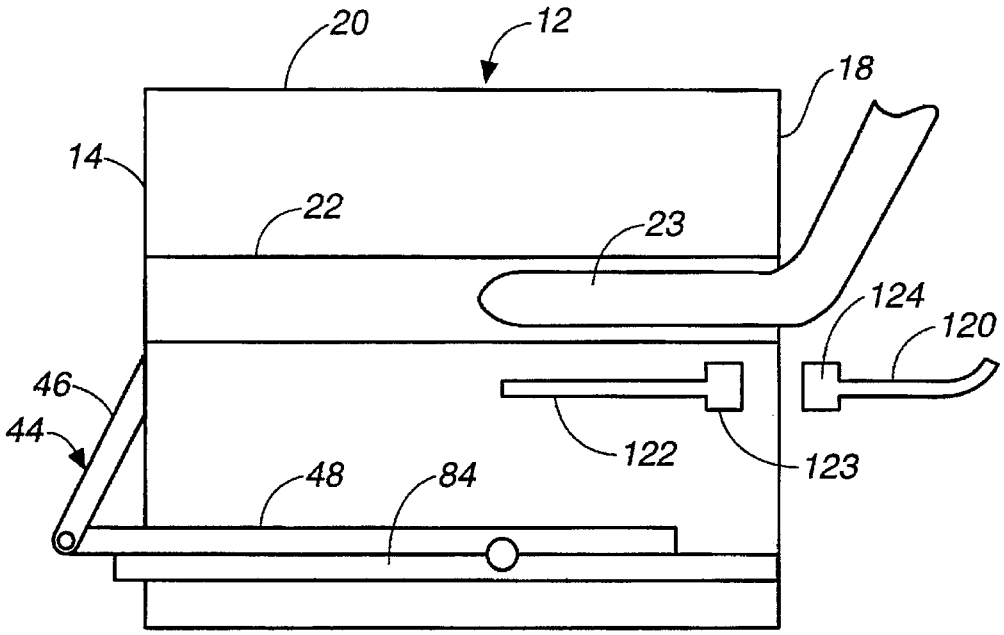
FIG. 5 is a side elevational view of the system of the present invention showing the quick disconnect means for the hydraulic lines carried by the container.

The frame or carriage 50 does not have to be pulled out to the maximum distance in frame tracks 52 and 54. The motor 60 will be controlled with control means 19 (FIG. 1) by a person sitting in the cab of vehicle 30, and the frame 50 can be moved the full distance out of its nesting relationship with tracks 52 and 54 or only partially outwardly from said tracks as shown in FIG. 4. When so moved, the frame 50 allows arm 46 to pivot from the full line position of FIG. 4 to the dashed line position thereof. Thus, the work bucket 91 attached to the outer end of the pick up unit, as hereinafter described, is moved from an upright position into a dumping position as shown in FIG. 4 where the material in the work bucket is caused to fall by gravity out of the work bucket and into the container 12. Then, the motor 60 is driven in the opposite direction and caused to await infusion of additional materials therein for subsequent pick up by the same vehicle or another vehicle.

Figure 9:
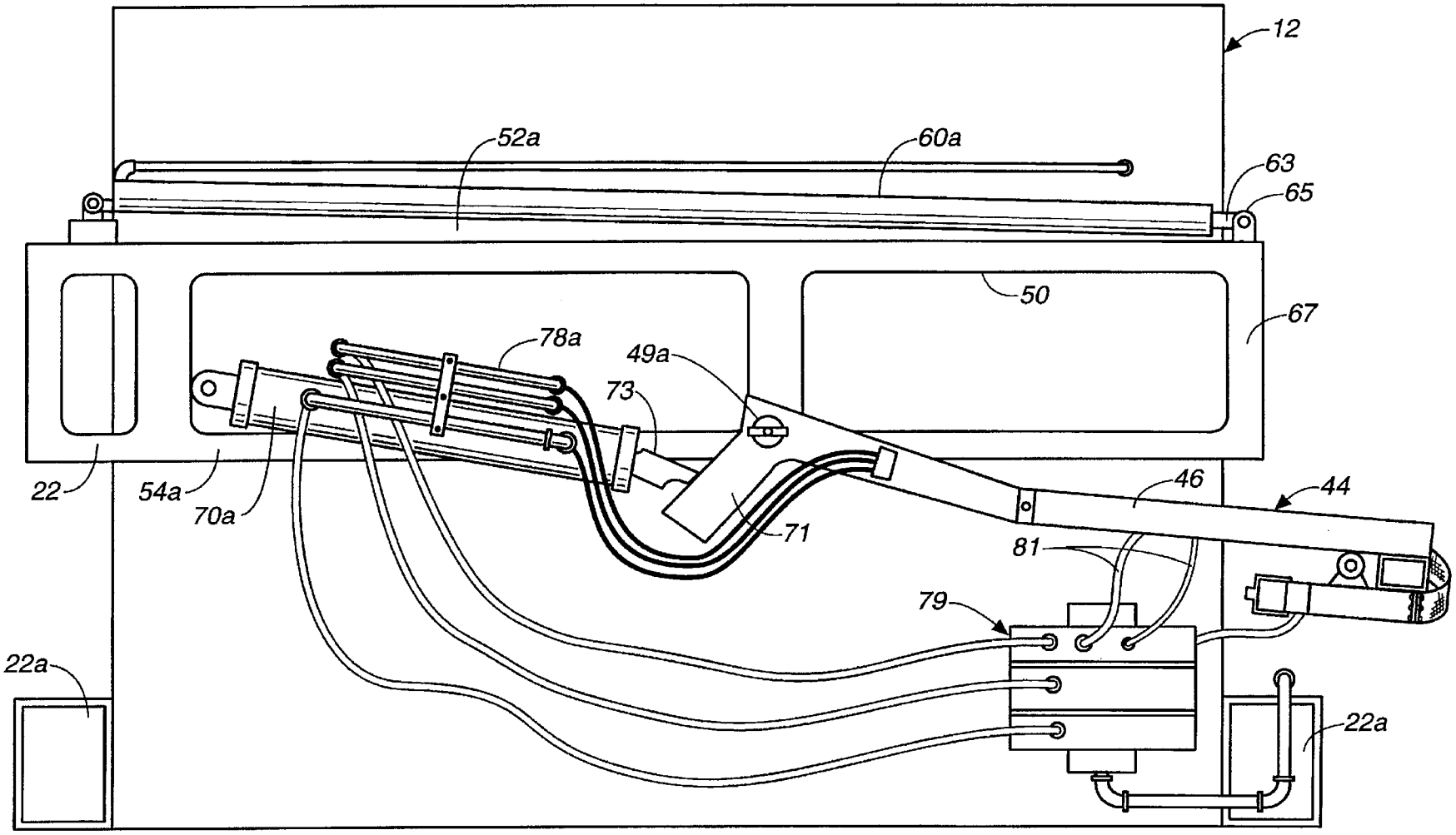
FIG. 9 is a front elevational view of the container of the second embodiment of the system showing the power device for shifting the support arm in a direction to lift the work bucket from the ground into dumping relationship with a container.

A fluid activated power device 70 is pivotally mounted by a pin 72 on the frame 50 with the outer end of the rod 74 of power device 70 being pivotally coupled to an ear 76 by a pin 78. Thus, upon actuation of power device 70 by supplying hydraulic fluid thereto under pressure, arm 44 will be swung into the dashed line position of FIG. 4 to dump the work bucket. The piston rod 74 will then return the arm 44 to its retracted position as shown in FIG. 4. In lieu of using a hydraulic motor 60 as shown in FIG. 4, a fluid piston cylinder assembly 60*a* can be used (see FIG. 9), the piston rod 63 of the assembly 60*a* being coupled by an ear 65 to the outer end 67 of support frame carriage 50.

The support arm 44 is pivotally carried by a pin 49*a* having a leg 71 which is coupled by the piston rods 73 of fluid piston and cylinder assembly 70*a*. To shift the carriage relative to tracks 52*a* and 54*a*, and into the bucket pick up position, fluid piston and cylinder assembly 70*a* is actuated in the usual manner and this causes frame 50 to slide relative to tracks 52*a* and 54*a* and move the arm 44 into a pick up position such as the pick up position shown in FIG. 4.

Figure 2:
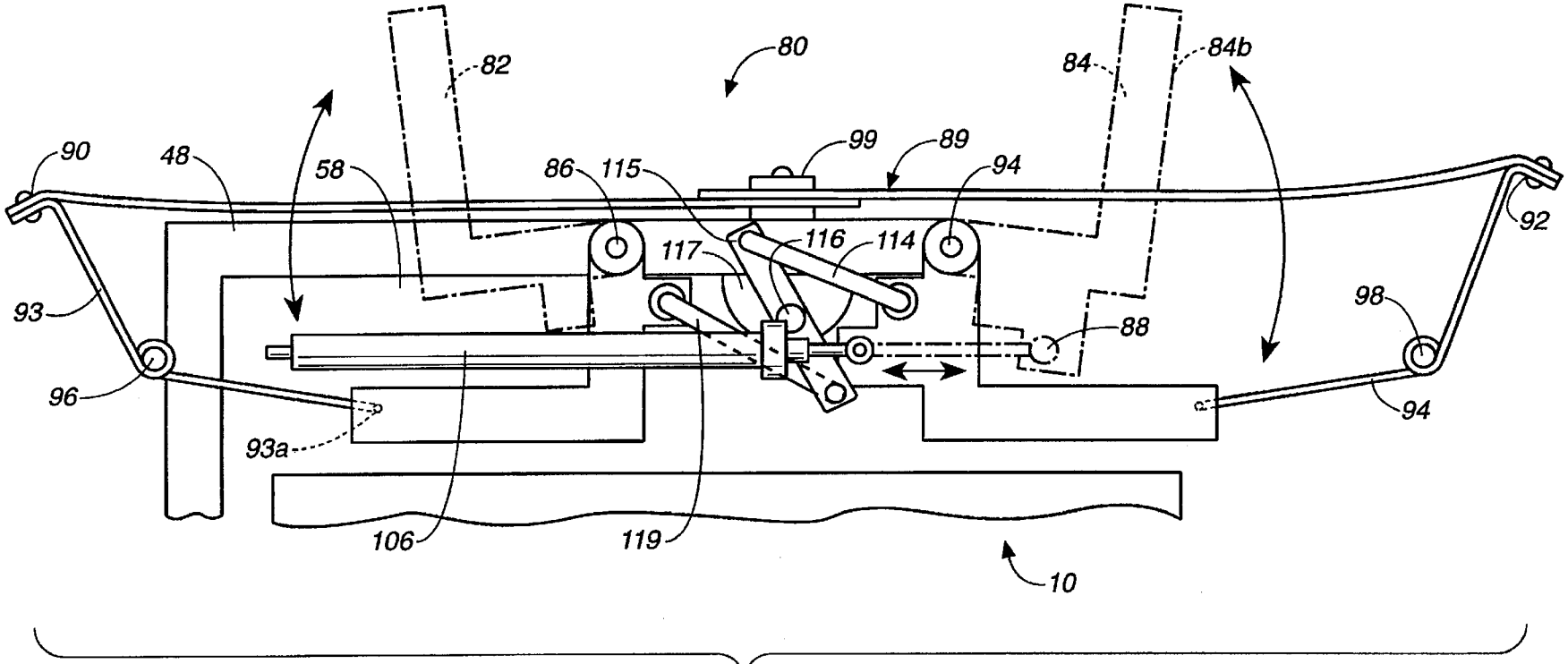
FIG. 2 is a bottom plan view of the means for holding a work bucket and lifting the work bucket from an initial position to an elevated position for dumping the contents of the work bucket into the container of FIG. 1.
Figure 4A:
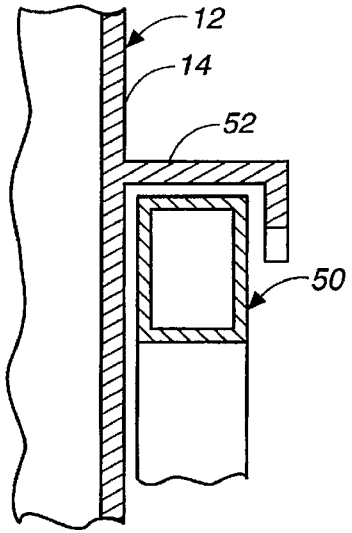
FIG. 4A is a cross sectional view taken along line 4A—4A of FIG. 4.
Figure 3:
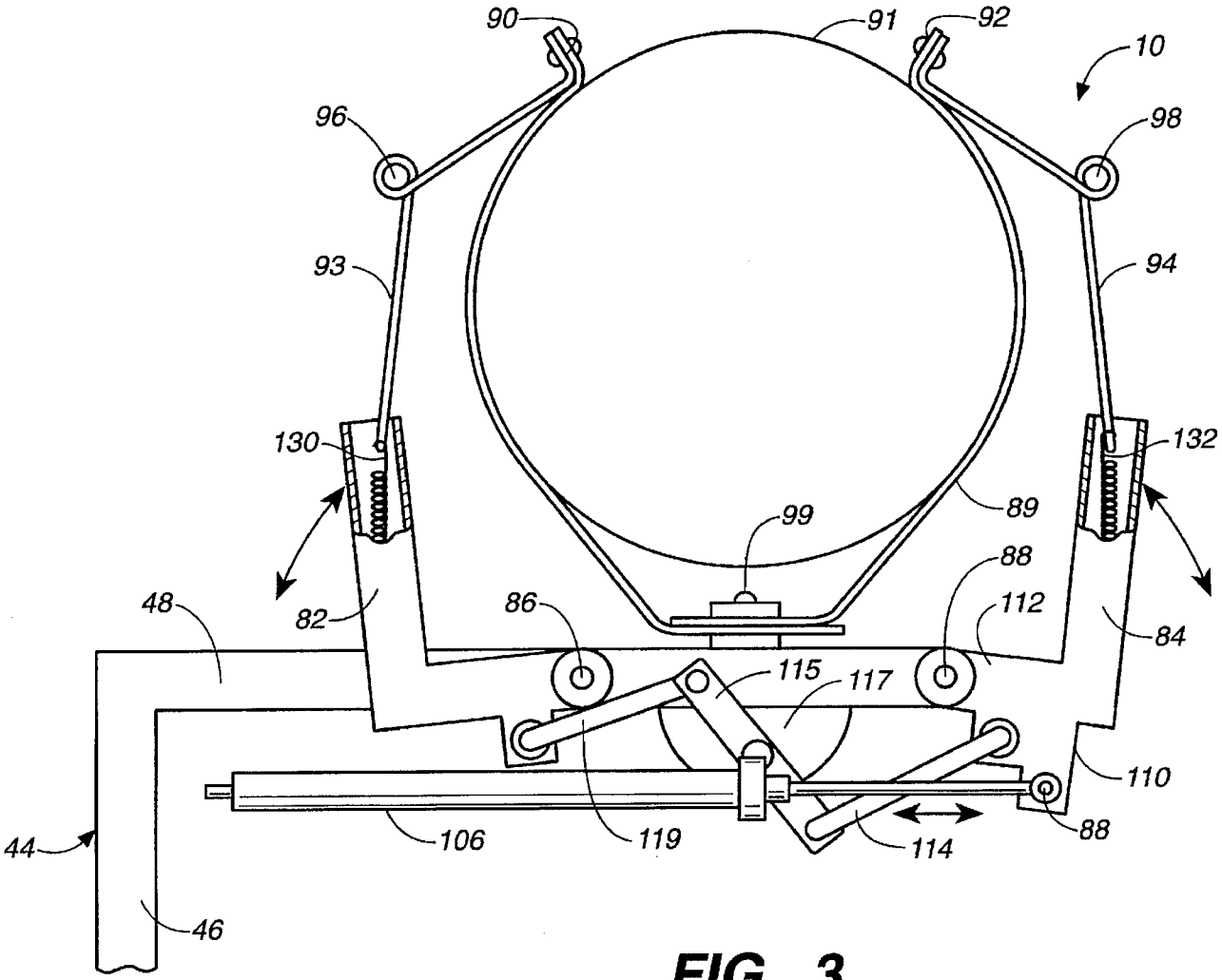
FIG. 3 is a bottom plan view, on an enlarged scale, of the holding means with the work bucket being embraced by the flexible strap wound about a portion of the circumference of the work bucket.

A work bucket holder 80 is shiftably carried on the outer segment 48 of L-shaped support arm 44. Segment 48 pivotally mounts a pair of L-shaped elements 82 and 84 by means of pivot pins 86 and 88. These L-shaped elements 82 and 84 are movable from the full line retracted positions thereof as shown in FIG. 2 to the operative positions of FIG. 3. In these positions, a flexible strap 89 is secured and extends between the outer ends 90 and 92 of a pair of springs 93 and 94 in the form of bars as shown in FIG. 3. The inner end of each of the spring elements is coupled to the corresponding L-shaped element 82 or 84.

A fastening device 99 secures the mid-point of strap 89 to segment 48 of the support 43. Strap 89 can be of one-piece or two-piece construction as shown in FIG. 3.

The position of strap or belt 89, when it is in a stand by or retracted position, is shown in FIG. 2. In this case, the plane of the belt is substantially vertical although there could be some sag which would make it depart from the true vertical.

A fluid piston and cylinder assembly 106 has a piston 108 which is coupled to an ear 110 on one arm 112 of element 84 so that, as the piston rod 108 expands, it forces element 84 into the dashed line, operative position of FIG. 2. Simultaneously with this movement the movement of L-shaped element 84 is transferred to a link 114 which, in turn, is pivotally mounted to a link 115 which is mounted by a pin 116 on a projection 117 of the arm segment 48 of arm 44.

A link 119 is pivotally coupled to L-shaped element 82 to cause it to move from the full line position of FIG. 2 to the full line position of FIG. 3 simultaneously with the movement of L-shaped element 84 to the dashed line position of FIG. 2. Thus, when this action occurs, elements 82 and 84 rotate relative to segment 48 as power device 106 rotates element 84 which, in turn, through links 106 and 119 rotate relative to the container 14.

As the elements 82 and 84 move into the dashed line positions of FIG. 2, they assume the operative positions shown in FIG. 3 in which the strap 89 is partially wrapped around the work bucket 91 but the degree of wrapping is greater than 180°, it preferably being approximately 270° so as to substantially embrace and frictionally engage the work bucket 91 and hold it as the work bucket 91 is lifted from the full line position of FIG. 4 into the dashed line position and into the dumping position. The dumping position is achieved by the pivoting of segment 50 on pin 49 (FIG. 4).

Figure 8:
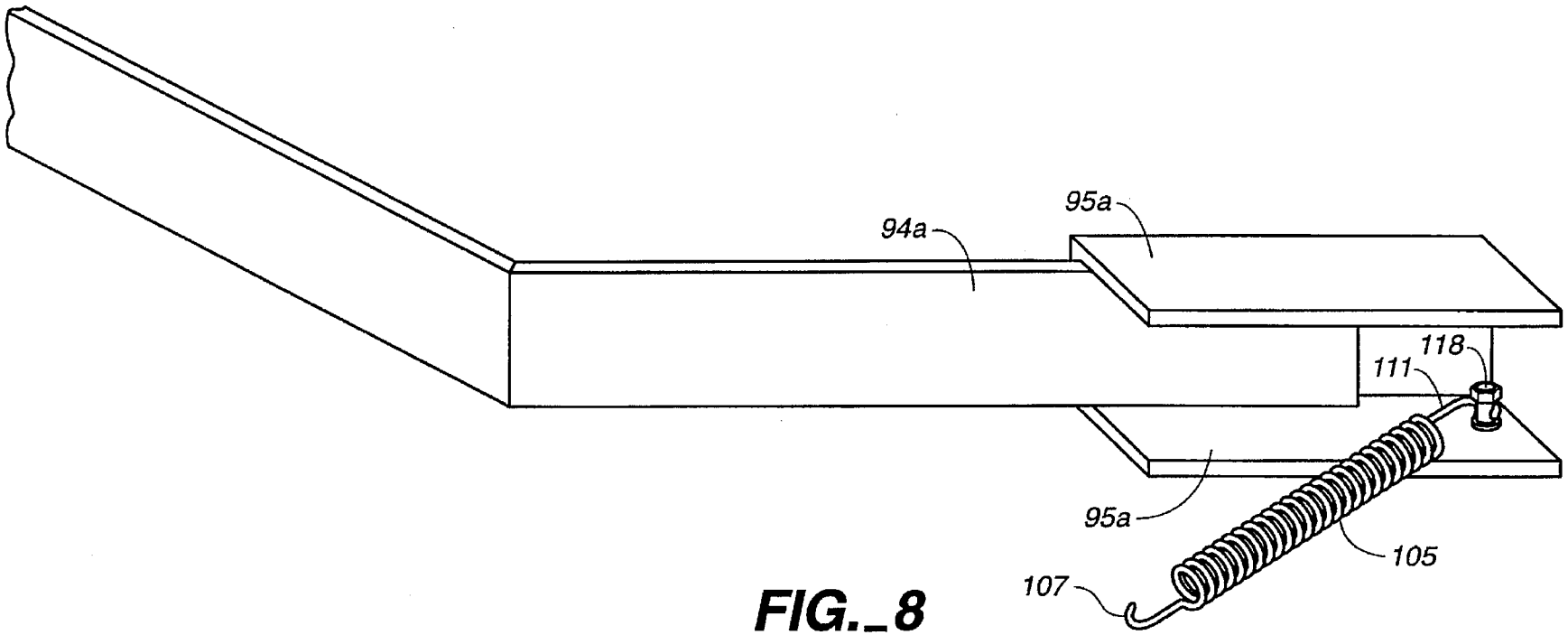
FIG. 8 is an enlarged fragmentary, perspective view of one of the arms which is connected at one end to a strap for partially encircling a work bucket to be lifted.

Springs 93*a* and 94*a* are preferably made of bar stock as shown in FIG. 8. Both springs 93*a* and 94*a* are constructed in the manner shown in FIG. 8 except that the inner end of spring 93*a* is secured in some suitable manner at a location on the outer end of element 82. The outer end of spring 93*a* is secured to the end 90 of strap 89. There is no relative sliding movement between spring 93*a* and its corresponding element 82. However, there is a shifting of spring 94*a* in the tubular portion of element 84 and spring 94*a* has flanges 95*a* which guide spring 94*a* into and through the L-shaped element 84. A spring 105 is secured at one end 107 to a fastener 109 carried by the element 84 near the entrance end 84*b* (FIG. 2). Thus, spring 94*a* can shift relative to element 84.

Figure 6:
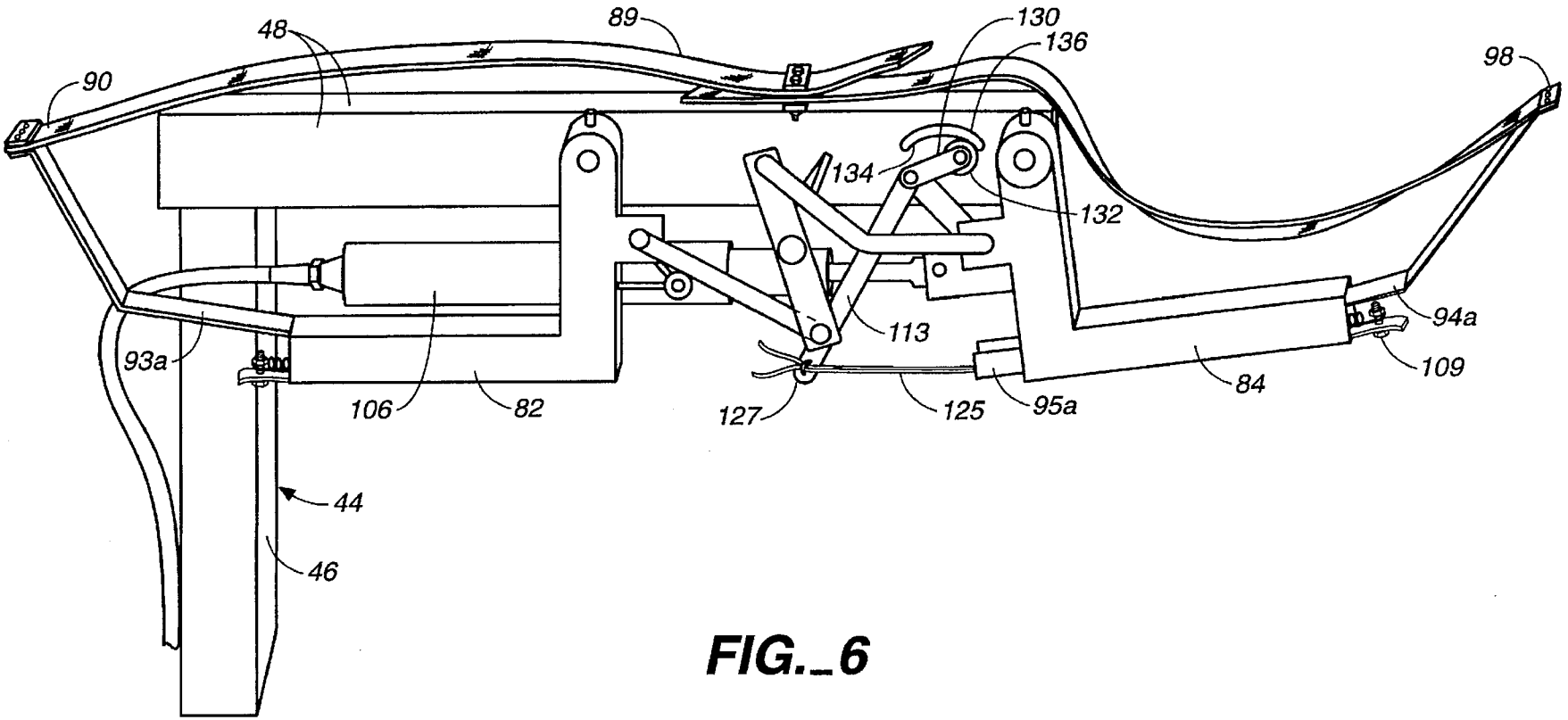
FIG. 6 is a view similar to FIG. 2 but showing another embodiment of the system of the present invention, the view being a fragmentary view of the combination of elements for grasping a work bucket and lifting the work bucket into dumping relationship with respect to the container of the system.
Figure 7:
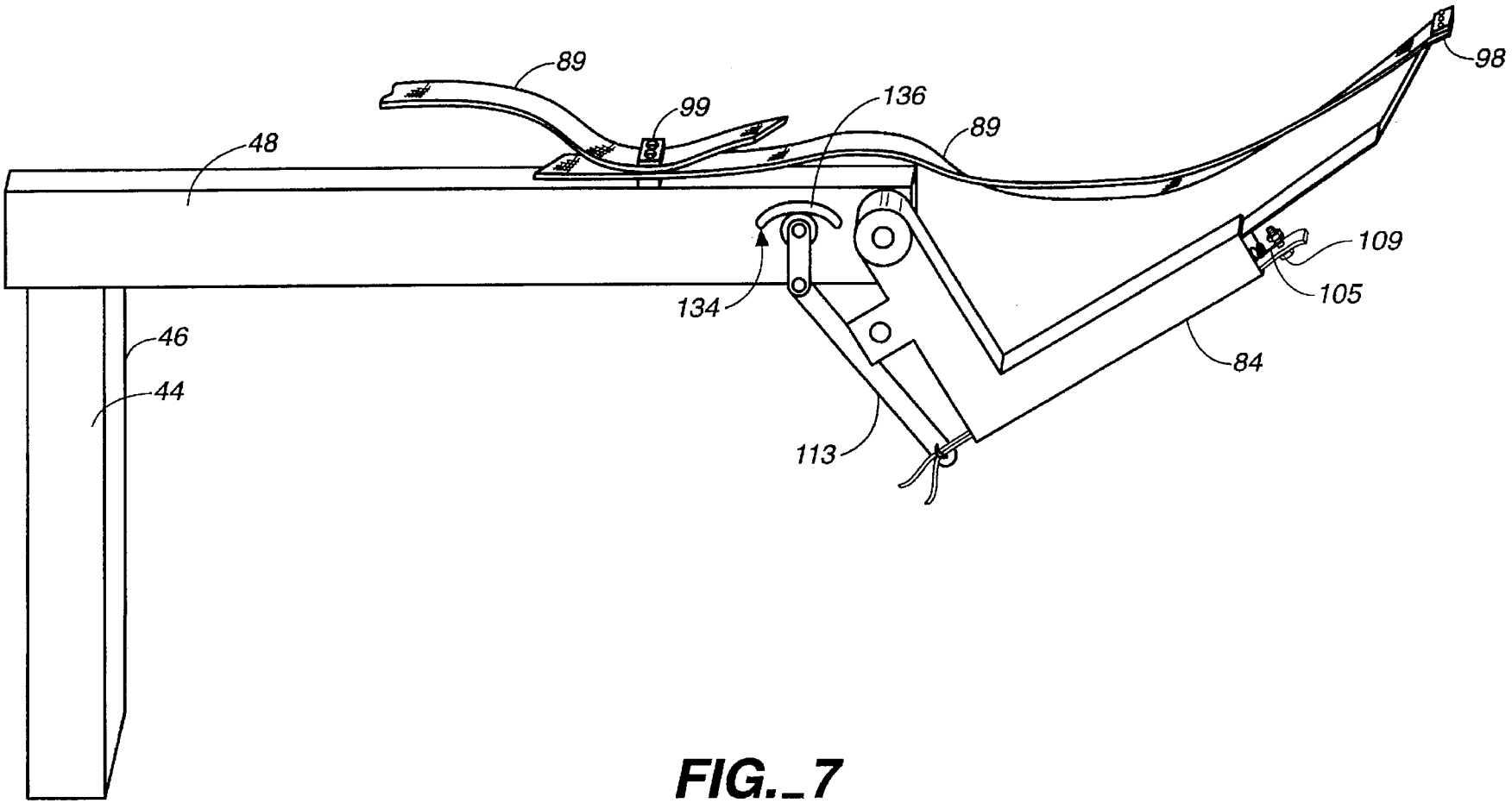
FIG. 7 is a bottom plan view of the portion of the system shown in FIG. 6.

The opposite end 111 of spring 105 is coupled by a fastener 118 to one of the flanges 95*a*. Thus, when fluid piston and cylinder assembly 106 is actuated, L-shaped elements 82 and 84 are moved into the full line position shown in FIG. 3 and the strap 89 wraps at least partially around the work bucket 91 to be elevated to a position above the container 12. FIG. 7 shows L-shaped element 84 partially pivoted relative to arm segment 48. Continued rotation of element 84 in a counterclockwise sense will cause the strap to move into the full line position of FIG. 3. As elements 82 and 84 move into their operative positions shown in FIG. 3, the spring is pulled in the direction away from the outer end of element 82 and the fastener 118 is coupled with spring or wire means 125 (FIG. 6). The outer end of spring means 125 is coupled to one end 127 of member 113 which is coupled to link 114. The opposite end of link 113 has a link 130 which carries a roller 132 which bears against the concave surface 134 of an abutment 136 such as a curved plate secured to the adjacent surface of end segment 48 of lateral arm 44. This spring arrangement allows for take-up of the strap if the strap is too long and also dimensions the various parts shown in FIGS. 2 and 6 in such a way that the parts do not interfere or engage other parts which are to be kept separate from the first mentioned parts.

In operation, container 12 is coupled by blades 23 of a vehicle 30 at side compartments 22 or 22*a*. With the container being carried on the forks at all times, and for all locations of the movement of the vehicle.

When it is desired to pick up a work bucket 91, the vehicle is driven close by the location of the work bucket, whereupon, by manipulation of controllers 19 in the cabin of the vehicle 30, the operator of the vehicle can manipulate elements 82 and 84 and thereby the band 89 so as to cause it to embrace the work bucket 91 in the manner shown in FIG. 3. The work bucket is lifted off the ground (FIG. 4) to the elevated, dumped position in which the work bucket is inverted so that the contents of the work bucket can be deposited in the container 12. Then the work bucket is replaced on the surface therebelow and the vehicle moves to the next work bucket for pick up thereby by the operation of the elements 82 and 84.

When the container 12 is full, it can be dumped as shown in FIG. 1 into the open front top of the vehicle 30 and eventually the vehicle will get full and when this occurs, the vehicle will be separated from the container 12 and driven without the container attached to the dumpsite where the front loader vehicle 30 is dumped in the usual, conventional manner. In the alternative, the blades 23 can be in compartments 22*a* whereupon the container can be moved into the inverted position of FIG. 10 and be taken to a dumpsite without separating the container from the vehicle.

All the power devices of the present invention typically are hydraulically actuated, although they can be of other construction if desired. For delivery of hydraulic fluid to the power devices, a fluid line 120 is adapted to be coupled to a source of hydraulic fluid under pressure carried by the vehicle 30 in some suitable location. A line 122 carried by container 12 is coupled with line 120 with quick release fastener members 123 and 125 and the change over from disconnect to connect is a matter of a few seconds, at most. Thus, the container can be quickly and easily separated from the vehicle 30 when the vehicle has to be used on its own without the container carried by blades 23 on the front of the vehicle 30 as shown in FIG. 1.

I claim:

1. A materials collection system comprising:

an open top container having a front end;

means coupled with the container for moving the container along a path over the ground with said container being in advance of said moving means;

an arm;

means for shiftably mounting the arm on the front end of the container for movement relative to and laterally of the path and for pivotal movement about an axis extending longitudinally of said path, said moving means including a vehicle having an operator station with said operator station being located to permit the vehicle operator at said operator station to have a line-of-sight view of the arm as said arm moves laterally and pivotally of the container;

a first power device coupled with the arm for shifting the arm laterally of said path;

said arm being movable relative to said mounting means from a first retracted position adjacent to the container to a second operative position adjacent to a work bucket station adjacent to said path;

a second power device coupled with the arm for pivoting the arm about said axis, whereby the arm can be moved from said operative position to an elevated position over the container;

a bucket gripper assembly shiftably mounted on the arm and capable of being shifted relative to the arm from a first, retracted location spaced from and adjacent to a work bucket to a second, operative location in which the gripper assembly embraces and is coupled to a work bucket;

a third power device for shifting said gripper assembly relative to the arm;

the arm being shiftable between the first and second positions after the gripper assembly has been embraced and coupled to a work bucket, whereby the arm and the work bucket can be lifted as a unit into dumping relationship above the open top of the container; and control means carried by the vehicle at the operator station for controlling the operation of the power devices.

2. A materials collection system as set forth in claim 1, wherein said assembly includes a flexible strap.

3. A materials collection system as set forth in claim 1, wherein said gripper assembly includes a flexible strap having a pair of opposed ends, and means coupling the ends of the strap to the arm.

4. A materials collection system as set forth in claim 3, wherein the strap is formed of two segments, the segments being joined at a location between the outer ends of the strap.

5. A materials collection system as set forth in claim 3, wherein the length of the strap is greater than one-half the perimeter of the work bucket.

6. A materials collection system as set forth in claim 1, wherein the container is removably mounted on the vehicle.

7. A materials collection system as set forth in claim 1, wherein said vehicle includes a front end loader vehicle having a top opening and a pair of spaced pickup blades at the sides, means on the sides of the container for removably receiving the blades, and means for lifting the blades and thereby the container to a location in which the container is tilted into dumped relationship to said vehicle.

8. A materials collection system as set forth in claim 1, wherein the assembly includes a strap having a length less than the perimeter of the work bucket, the strap being fixed to the arm substantially midway between the ends of the strap.

9. A materials collection system as set forth in claim 8, wherein the strap is resilient.

10. A materials collection system as set forth in claim 1, wherein said assembly includes a pair of elongated rotatable elements, each element being rotatably mounted at one end thereof to the arm, and a pair of gripping members coupled to the arm and being movable toward each other and in at least partially embracing, coupled relationship relative to the work bucket, said third power device being coupled with the gripping segments for rotating the elements relative to the arm.

11. A materials collection system as set forth in claim 10, wherein the arm is L-shaped to present a first segment extending transversely of the front end of the container and a second segment extending along one side of the container.

12. A materials collection system as set forth in claim 10, wherein the elements are L-shaped, said gripping members including a strap, the elements being rotatably mounted on the arm, and the strap having a central portion, and means coupling the central portion of the strap to the arm, the ends of the strap being secured to the outer ends of the elements.

13. A materials collection system as set forth in claim 12, wherein is included a spring bar provided for each L-shaped element, respectively, the outer ends of the strap being coupled to the outer ends of the spring bars.

14. A materials collection system as set forth in claim 1, wherein is included a carriage mounted for rectilinear movement on the front end of the container, said arm being mounted on the carriage for rectilinear movement therewith, and for pivotal movement of the arm and thereby said assembly relative to the container, said first power device being coupled to the carriage for moving the carriage laterally of the container, said second power device being operable for pivoting the arm relative to the carriage.

15. A materials collection system as set forth in claim 1, wherein said assembly includes a pair of elements rotatably mounted relative to the arm, link means coupling one element with the other element to rotate the other element relative to the arm in response to the rotation of the one element relative to the arm, said link means including an abutment plate carried by the arm, there being a rotatable member in rolling relationship to the plate, said one element being substantially hollow, there being a spring bar extending through the one element and shiftably mounted thereon, a spring biasing the spring bar in a direction away from said link when the strap embraces at least part of the perimeter of the work bucket, the bar being secured to one end of the link for causing movement of the rotatable member in engagement with the abutment plate.

16. A materials collection system as set forth in claim 1, wherein said assembly includes a pair of gripping members, each member having an end rotatable relative to said arm, means responsive to the third power device for moving the ends and thereby the gripping members at least partially about a work bucket to be picked up and pivoted into an upside down position above the container.

17. A materials collection system as set forth in claim 1, wherein the first, second and third power devices are fluid powered drive units, and including a source of fluid under pressure carried by the vehicle, said container having a fluid line coupled to the drive units, and quick-release fluid flow means for coupling the power devices with the fluid source of the vehicle.

18. In a materials collection system of the type having a vehicle:

an open top container having a front end;

means on the container for removably coupling the container to the vehicle whereby the container can be moved along a path over the ground with said container being in advance of said vehicle;

an arm;

means for shiftably mounting the arm on the front end of the container for movement relative to and laterally of the path and for pivotal movement about an axis extending longitudinally of said path, said vehicle having an operator station located to permit, when the container is coupled to the vehicle, the vehicle operator at said operator station to have a line-of-sight view of the arm as said arm moves laterally and pivotally of the container;

a first power device coupled with the arm for shifting the arm laterally of said path;

said arm being movable relative to said mounting means from a first retracted position adjacent to the container to a second operative position adjacent to a work bucket station adjacent to said path;

a second power device coupled with the arm for pivoting the arm about said axis, whereby the arm can be moved from said operative position to an elevated position over the container;

a bucket gripper assembly shiftably mounted on the arm and capable of being shifted relative to the arm from a first, retracted location spaced from and adjacent to a work bucket to a second, operative location in which the gripper assembly embraces and is coupled to a work bucket;

a third power device for shifting said gripper assembly relative to the arm;

the arm being shiftable between the first and second positions after the gripper assembly has embraced and has been coupled to a work bucket, whereby the arm and the work bucket can be lifted as a unit into dumping relationship above the open top of the container; and the vehicle having control means at the operator station for controlling the operation of the power devices.

19. In a materials collection system as set forth in claim 18, wherein said assembly includes a flexible strap.

20. In a materials collection system as set forth in claim 19, wherein the length of the strap is greater than one-half the perimeter of the work bucket.

21. In a materials collection system as set forth in claim 18, wherein said gripper assembly includes a flexible strap having a pair of opposed ends, and means coupling the ends of the strap to the arm.

22. In a materials collection system as set forth in claim 18, wherein the strap is formed of two segments, the segments being joined at a location between the outer ends of the strap.

23. In a materials collection system as set forth in claim 18, wherein the arm is pivoted about a horizontal axis extending fore and aft of the path.

24. In a materials collection system as set forth in claim 18, wherein said vehicle includes a front end loader vehicle having a top opening and a pair of spaced pickup blades at the sides, means on the sides of the container for removably receiving the blades, said vehicle having means for lifting the blades and thereby the container to a location in which the container is tilted into dumped relationship to said vehicle.

25. In a materials collection system as set forth in claim 18, wherein the assembly includes a strap having a length less than the perimeter of the work bucket, the strap being fixed to the arm substantially midway between the ends of the strap.

26. In a materials collection system as set forth in claim 18, wherein the strap is resilient.

27. In a materials collection system as set forth in claim 18, wherein said assembly includes a pair of elongated rotatable elements, each element being rotatably mounted at one end thereof to the arm, and a pair of gripping members coupled to the arm and being movable toward each other and in at least partially embracing, coupled relationship relative to the work bucket, said third power device being coupled with the gripping segments for rotating the elements relative to the arm.

28. In a materials collection system as set forth in claim 27, wherein the arm is L-shaped to present a first segment extending transversely of the front end of the container and a second segment extending along one side of the container.

29. In a materials collection system as set forth in claim 27, wherein the elements are L-shaped, said gripping members including a strap, the elements being rotatably mounted on the arm, and the strap having a central portion, and means coupling the central portion of the strap to the arm, the ends of the strap being secured to the outer ends of the elements.

30. In a materials collection system as set forth in claim 24, wherein is included a spring bar provided for each L-shaped element, respectively, the outer ends of the strap being coupled to the outer ends of the spring bars.

31. In a materials collection system as set forth in claim 18, wherein is included a carriage mounted for rectilinear movement on the front end of the container, said arm being mounted on the carriage for rectilinear movement therewith, and for pivotal movement of the arm and thereby said assembly relative to the container, said first power device being coupled to the carriage for moving the carriage laterally of the container, said second power device being operable for pivoting the arm relative to the carriage.

32. In a materials collection system as set forth in claim 18, wherein said assembly includes a pair of elements rotatably mounted relative to the arm, link means coupling one element with the other element to rotate the other element relative to the arm in response to the rotation of the one element relative to the arm, said link means including an abutment plate carried by the arm, there being a rotatable member in rolling relationship to the plate, said one element being substantially hollow, there being a spring bar extending through the one element and shiftably mounted thereon, a spring biasing the spring bar in a direction away from said link when the strap embraces at least part of the perimeter of the work bucket, the bar being secured to one end of the link for causing movement of the rotatable member in engagement with the abutment plate.

33. In a materials collection system as set forth in claim 18, wherein said assembly includes a pair of gripping members, each member having an end rotatable relative to said arm, means responsive to the third power device for moving the ends and thereby the gripping members at least partially about a work bucket to be picked up and pivoted into an upside down position above the container.

34. In a materials collection system as set forth in claim 18, wherein the first, second and third power devices are fluid powered drive units, and including a source of fluid under pressure carried by the vehicle, said container having a fluid line coupled to the drive units, and quick-release fluid flow means for coupling the power devices with the fluid source of the vehicle.

* * * * *